United States Patent [19]

Perlino

[11] Patent Number: 4,467,736

[45] Date of Patent: Aug. 28, 1984

[54] AUTOMATIC APPARATUS FOR EXECUTING SEWINGS ACCORDING TO A DETERMINED CONTOUR

[75] Inventor: Silvano Perlino, Pavia, Italy

[73] Assignee: Necchi Societa per Azioni, Pavia, Italy

[21] Appl. No.: 489,147

[22] Filed: Apr. 27, 1983

[30] Foreign Application Priority Data

May 17, 1982 [IT] Italy ..... 42906 A/82

[51] Int. Cl.[3] ..... D05B 3/02

[52] U.S. Cl. ..... 112/121.14; 112/121.15

[58] Field of Search ..... 112/121.14, 121.11, 112/121.12, 121.15, 308, 309; 38/5/22

[56] References Cited

U.S. PATENT DOCUMENTS

| | | | |
|---|---|---|---|
| 891,611 | 6/1908 | Emerson | 38/5 |
| 2,345,104 | 3/1944 | Dittrich | 112/121.12 |
| 3,180,292 | 4/1965 | Allen | 112/121.14 |

*Primary Examiner*—H. Hampton Hunter

*Attorney, Agent, or Firm*—Stevens, Davis, Miller & Mosher

[57] ABSTRACT

Automatic apparatus for executing sewings according to a determined contour, comprising a sewing machine movable along two horizontal axes and a fixed work support capable of carrying out reversible axial rotations of 180° at the end of each sewing cycle for transferring the fabric from a loading station to a sewing station. The sewing machine covers the swing path, every time along a direction opposite to the previous one.

1 Claim, 2 Drawing Figures

AUTOMATIC APPARATUS FOR EXECUTING SEWINGS ACCORDING TO A DETERMINED CONTOUR

BACKGROUND OF THE INVENTION

The present invention relates to an automatic apparatus for executing sewings according to a determined contour. Automatic units, arranged for executing sewing works of the mentioned type, are known in the art. In these, a sewing machine is mounted on an appropriate system of slides moving on corresponding guides perpendicular to each other so as to give the machine a composite movement along two orthogonal axes X and Y, so that the sewing machine needle will be able to occupy each desired point of a plane path.

Usually, the movement to the guide system was given by a follower connected to the slide system and forced to rotate along a fixed pattern reproducing the shape of the sewing to be executed. The coupling between follower and pattern might be either of the magnetic type or be formed by a pinion and toothing made out along the contour of the same pattern.

In the described automatic units known in the art, there are some drawbacks which compromise their efficiency and cost. First, it is necessary to arrange interchangeable patterns for executing sewings of different contour and, second, it is difficult, if not altogether impossible, for the operator to carry out the sewing preparation while the machine executes the sewing on a work piece previously arranged on the apparatus.

SUMMARY OF THE INVENTION

It is an object of the present invention to improve the already known apparatus and eliminate the above cited drawbacks. The proposed solution for attaining the object foresees an apparatus comprising a sewing machine arranged to carry out movements along two orthogonal axes following paths whose points are determined according to data stored in a memory and a work support comprising a sewing station and a loading station. The work support presents two symmetrically disposed and equally shaped portions on which the fabric to be worked is alternatively loaded and sewn and is axially rotatable 180° at the end of each sewing cycle executed by the sewing machine, which covers the sewing path being covered, every time along a direction opposite to the previous one.

DESCRIPTION OF THE PREFERRED EMBODIMENT

Figure 1:
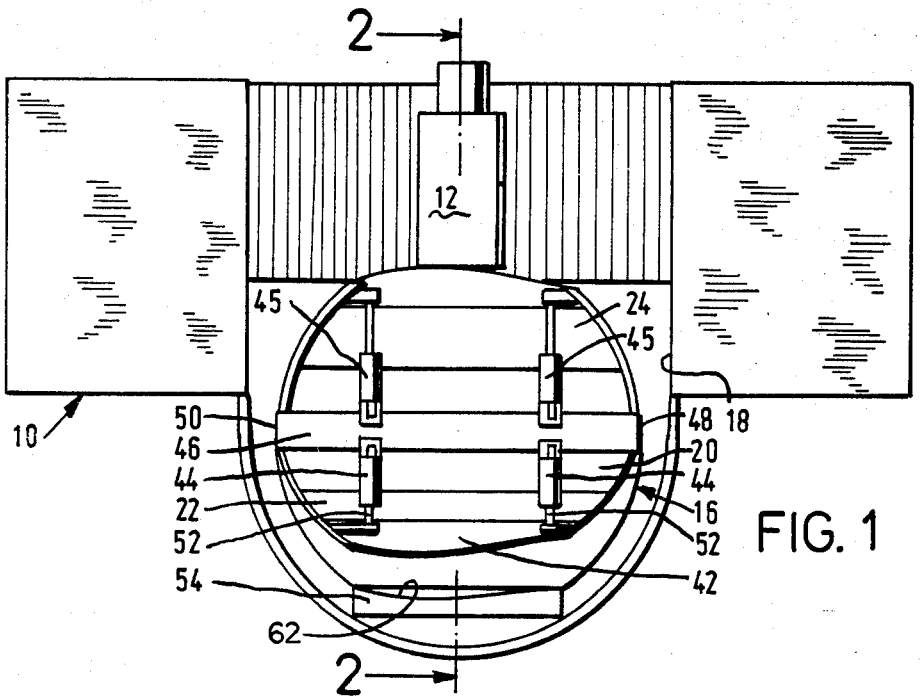
FIG. 1 shows a plan view of the apparatus of the invention.

With reference to FIG. 1, the reference number 10 indicates the support of a sewing machine 12 which is mounted on two slides adapted to run along two guide systems, arranged perpendicular to each other, by means of two motors driven through an electronic control system in accordance with current signals piloted by data stored in a static memory.

The control system, as well as the guides, the slides and the motors have not been illustrated in the drawings as they are well known in the art and do not form the object of the inventive idea characterizing the invention.

A work suport generically indicated by 16 is arranged in appropriate position with respect to the machine support. The work support is on its upper part substantially circular in shape and is disposed partially within an opening 18 of the machine support 10. Within the same opening 18, the sewing machine carries out its displacements along the corresponding guides.

The work support 16 is formed by a U-shaped body 20 provided with two horizontal tongues 22, 24 placed on the upper part and protruding outside.

Figure 2:
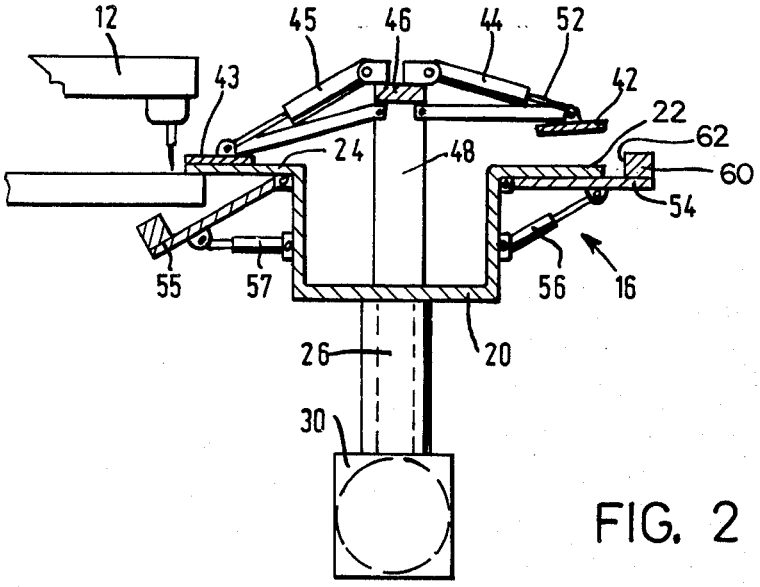
FIG. 2 is a sectional view taken along line 2—2 of the apparatus of FIG. 1.

In the lower part of this body 20, there is connected a cylindrical standard 26 (FIG. 2) mounted for rotation on a proper seat borne by the sewing machine support 10, and not shown in the drawings.

A rotating pneumatic actuator, not shown, contained in the closed space 30, has the task, in synchronism with the operative cycle of the apparatus, of rotating the cylindrical standard 26 180° alternatively in the opposite direction.

The tongues 22 and 24 have an outer contour identical to the contour of the sewing to be executed, upon which the fabric to be sewn is placed. The fabric may be, for example, formed by a portion of a coat and by the revers, which has to be sewn upon it. In this case, the edge of the coat, upon which the revers is sewn, is placed upon the tongue 22 and the remaining portion is positioned upon the edge of the coat.

A clamp 42 is provided for clamping the fabric upon the tongue 22.

The clamping and opening movements of the clamp 42 are obtained by the operation of a couple of pneumatic cylinders 44 pivoted on a support bar 46 running over the body 20 and borne by the standards 48 and 50 fixed to the same body. The stems 52 of the cylinders 44 are connected to the upper portion of the clamp 42.

Below the tongue 22, pivoted on the vertical wall of the body 20, is a reference element 54 with its outer contour protruding from the edge of the tongue 22. The element is driven by the cylinder 56 arranged as illustated in FIG. 2, and has the task of helping the operator place the fabric in a correct position upon the tongue 22. To this purpose, the element 54 is moved by the couple of cylinders 56 into contact with the tongue 22, when the clamp 42 is open, and is rotated downwardly when the clamp 42 closes in order to clamp the fabric. Element 54 has a guide section 60 extending upwardly therefrom having a contour 62 identical to the contour of tongue 22. In preparing the fabric for sewing the operator places the fabric upon the tongue 22 and the edge of the fabric against contour 62 of the guide section 60. The clamp 42 is moved downwardly to clamp the fabric between clamp 42 and tongue 22 after which element 54 is pivoted downwardly so that when cylindrical standard 26 is rotated through 180° element 54 will not strike the machine support 10 or the sewing machine needle. The work support 16 presents an equal conformation symmetrically opposite to the aforedescribed, i.e., an upper couple of cylinders 45, the clamp 43, the reference element 55 and the couple of cylinders 57, all pertinent to the tongue 24.

By means of the aforedescribed apparatus, it is possible to prepare the fabric to be sewn while the machine is executing the sewing of the fabric previously placed upon the support 16. This is achieved because the support 16 stands still, while the sewing machine 12 moves over the clamp within the opening 18.

The machine 12 moves from right to left in performing the sewing, then stops in correspondence with the last stitch and gives the signal for the rotation of the support 16 in the way already explained.

The machine 12 then sews the new fabric while moving in a direction opposite to its previous direction.

I claim:

1. Automatic apparatus for executing sewings according to a determined contour, comprising a sewing machine arranged to carry out movements along two orthogonal axes following path whose points are determined according to data stored in a memory, a pivotal work support having a work holdup surface on only one side thereof comprising a sewing station and a loading station defining two symmetrically disposed and equally shaped portions on said work holding surface on which the fabric to be worked is alternatively loaded and sewn, clamping means to hold said fabric on said shaped portions prior to and during sewing, and means to axially rotate said work support along a vertical axis 180° at the end of each sewing cycle executed by said sewing machine, the sewing path, every time moving in a direction opposite to the previous one.

* * * * *